United States Patent [19]

Semenenko et al.

[11] 3,979,937

[45] Sept. 14, 1976

[54] PAIRED-ROLL STRAIGHTENING MACHINE

[76] Inventors: Jury Lukich Semenenko, ulitsa Gogolya 1, kv. 30; Nikolai Vasilievich Tumanov, ulitsa Simropolskaya, 23, kv. 5, both of Dnepropetrovsk, U.S.S.R.

[22] Filed: Apr. 7, 1975

[21] Appl. No.: 565,841

[52] U.S. Cl. ..... 72/160; 72/190

[51] Int. Cl.[2] ..... B21D 3/08

[58] Field of Search ..... 72/160, 164, 79, 190

[56] References Cited

UNITED STATES PATENTS

| | | | |
|---|---|---|---|
| 3,492,852 | 2/1970 | Perner | 72/164 |
| 3,557,593 | 1/1971 | Bollig et al. | 72/190 |
| 3,672,197 | 6/1972 | Popov | 72/79 |
| 3,748,884 | 7/1973 | Colbath | 72/181 |

*Primary Examiner*—Milton S. Mehr
*Attorney, Agent, or Firm*—Holman & Stern

[57] ABSTRACT

A paired-roll straightening machine designed for straightening rolled shapes, round and shaped tubes and rolled section stock comprises a number of stationarily installed stands mounting pairs of driving shafts which form passes by their rolls, corresponding to the cross section of an article being straightened. The rolls form pairs with some of the pairs intended for propelling the article and the remaining pairs for bending the article. Each roll of the pairs intended for bending the article is provided with an individual drive for rocking in a given plane. In addition, each bending pair of rolls is provided with an additional drive for combine rocking of both rolls of the pair in a plane perpendicular to the given one. This allows for multiplanar elastoplastic bending of the article to be performed in the course of straightening.

6 Claims, 6 Drawing Figures

PAIRED-ROLL STRAIGHTENING MACHINE

BACKGROUND OF THE INVENTION

The present invention relates to means for straightening articles by repeated reversed elasto-plastic bending and more particularly to paired-roll straightening machines used for straightening such articles as rolled shapes, shaped and round tubes, and rolled section stock.

Known in the art are paired-roll straightening machines comprising a number of stands with driving shafts installed therein in pairs and carrying rolls forming passes corresponding to the cross section of an article being straightened. All pairs of rolls are installed in stationary stands in such a manner that the passes formed thereby are located in a wavy line.

During the straightening of articles in these machines the number of bends given to an article and determining the quality of straightening is limited by the number of roll pairs 7–9. This limitation substantially reduces the efficiency of the machines of similar design and makes them unable to gain the required quality of straightening. On the other hand, increasing the number of roll pairs is restricted by the rational dimensional limits of the machines and the amount of energy spent for straightening an article.

Also known are paired-roll straightening machines with rocking stands performing circular motion (see, for example, Patent Nos. 1,017,447 and 1,205,797 issued in the Federal Republic of Germany). Each of the rocking stands in these machines comprises a frame, rolls, roll axles, roll axle supports, as well as adjusting and fixing elements.

During the straightening of articles in these machines, the number of bends given to an article is determined not by the number of roll pairs, but by the rocking frequency of the rocking stands. The number of bends given to an article on machines with rocking stands is several times larger than on machines with stationary stands, which ensures higher quality straightening. However, machines with rocking stands have intrinsic disadvantages generated from large inertial masses of the rocking stands. The displacement of large masses leads to the creation of considerable dynamic loads, which impairs both the increase of oscillating frequency of rocking stands and the improvement of straightening quality and speed. This is particularly manifest in straightening large rolled shapes and tubes.

To ensure high quality straightening of substantially large rolled shapes and tubes it is necessary that the oscillating frequency of the rocking stands be increased. On the existing straightening machines with rocking stands it is impossible to obtain the required oscillating frequency due to the limitations stemmed from the design principle of these machines, characterized by the large masses of rocking stands and the complicated and bulky drive used for rocking the stands.

Straightening of large-size articles in the known machines leads to the enlargement of dimensions and masses of their rocking stands, which entails a still further increase of inertial masses and correspondingly the creation of considerable dynamic loads brought to bear on the components of the straightening machines. In their turn, with increasing oscillating frequency of rocking stands the dynamic loads in the machine units are increasing in square. All this restricts the abilities of straightening machines with rocking stands and makes it impossible to obtain the required quality of straightening especially in the case with large rolled shapes and tubes.

Thus, all the existing straightening machines come short of solving the problem of improving the quality of straightening with simultaneous speeding-up of the straightening process.

SUMMARY OF THE INVENTION

The object of the present invention is to provide a paired-roll straightening machine in which inertial and dynamic loads created in the course of straightening an article are minimized, which in its turn, substantially speed-up the straightening process at high quality of straightening.

This and other objects of the present invention are achieved by a paired-roll straightening machine comprising a number of stands with driving shafts installed therein in pairs and carrying rolls forming passes corresponding to the cross section of an article being straightened, whereas some pairs of the rolls are used for propelling the article while the remaining ones are used for bending the article in at least one given plane during straightening, according to the invention, the stands with the bending pairs of rolls are installed stationarily and each roll of the bending pair is provided with an individual drive for its rocking in the given plane.

This solution of the problem allows for a transfer from the design of a paired-roll straightening machine with rocking stands to that of a machine with stationary stands whose frames, driving shafts and supports of these shafts are stationary, while the rocking motion is performed only by the rolls of a bending pair. The reduced value of rocking masses practically minimizes possible inertial and dynamic loads created, thus allowing the rocking frequency of the rolls to be increased with consequent speeding-up of the straightening process, that is to improve the productive capacity of the machine. Higher rocking frequency of the rolls permits more bends to be given to an article being straightened to result in improved quality of straightening and a large assortment of articles to be straightened, including those of large dimensions.

The invention is characterized by that the individual drive for rocking a roll of the bending pair comprises a stand driving shaft and an eccentric bushing fixed on the shaft, while the roll is freely seated on the bushing. This construction of the drive greatly simplfies the means needed for bringing the rolls in rocking motion, makes the machine itself much simpler with possible reduction of its weight and dimensions.

The invention is also characterized by that each bending pair of rolls is provided with an additional drive for cooperative rocking of both rolls of a pair in a plane which is perpendicular to the given plane and, due to the composition of these two rocking motions a pass formed by this pair of rolls performs a circular motion for multiplanar bending of the article during straightening.

It is expedient that each drive for rocking a bending pair of rolls comprises a crank and connecting-rod assembly whose connecting rod is pivotally connected with a holder encompassing the pair of rolls.

Provision of the additional drive for each pair of bending rolls enables multiplanar elasto-plastic bending of the article, which is achieved by simply designed means and which eliminates three-dimensional curvature of articles at high accuracy.

The invention is also characterized by that the stands having the driving shafts with article-propelling pairs of rolls are stationarily installed through an interval of every two stands with bending pairs of rolls, whereas the position of the drive eccentric bushings of the rolls of the first bending pair (as viewed in the direction of article travel) is identical to that of the drive eccentric bushings of the second bending pair for synchronous rocking of the rolls of these pairs. This positioning of the stands is instrumental in improving the quality of straightening due to treating an article according to clear bending arrangement. In addition, this positioning of the stands and eccentric bushings reduces the force needed for bending an article during its straightening, thus improving the dependability and the durability of the machine.

Still further characteristic of the present invention is that the eccentricity of the drive eccentric bushings of the rolls of the first bending pair (as viewed in the direction of article travel) is larger than that of the drive eccentric bushings of the second pair rolls. This helps establish the most favorable conditions for straightening by way of smooth reduction of article deformation as the article progressively moves forward and effect more accurate straightening and minimal consumption of energy.

So, the paired-roll straightening machine of the instant invention as compared with the existing straightening machines features a simpler and more reliable design and, apart from that, solves the problem of improving the quality of straightening with simultaneous speeding-up of the straightening process through simple means, that is straightening of articles in this machine is performed at high speed and high accuracy.

BRIEF DESCRIPTION OF THE DRAWINGS

Other objects and advantages of the paired-roll straightening machine according to the present invention will be more clearly understood from the following detailed description of it embodiment given by way of example with reference to the accompanying drawings, in which.

DETAILED DESCRIPTION OF THE PREFERRED EMBODIMENT

Figure 1:
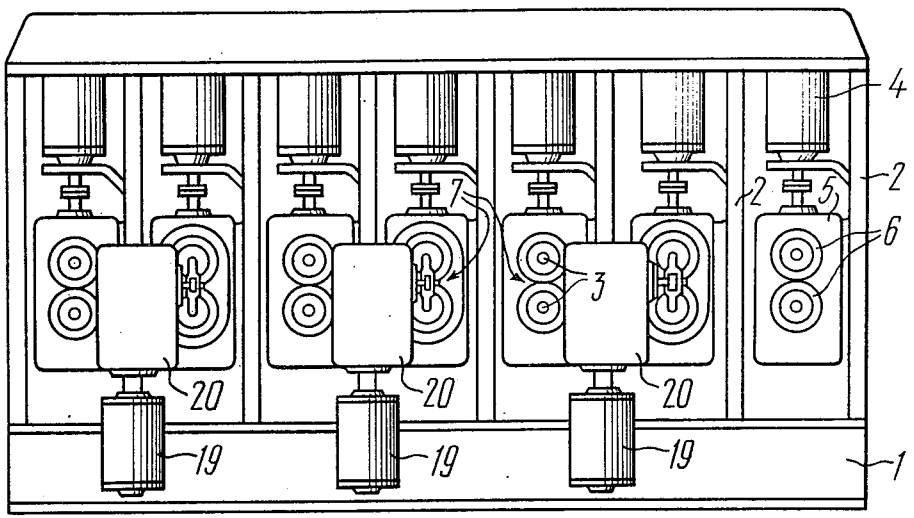
FIG. 1 is a general schematic view of the paired-roll straightening machine.

The paired-roll straightening machine comprises a bed frame 1 (FIGS. 1 and 2) on which stands 2 are stationarily installed in a row one after another.

Each stand 2 incorpoates a frame having supports such as antifriction bearings (not shown in the drawings because they are commonly known) carrying driving shafts 3. Each frame mounts two driving shafts 3 located horizontally one above the other, and drives to rotate the shafts 3, each of the drives comprising an electric motor 4 and a reduction unit 5.

Figure 2:
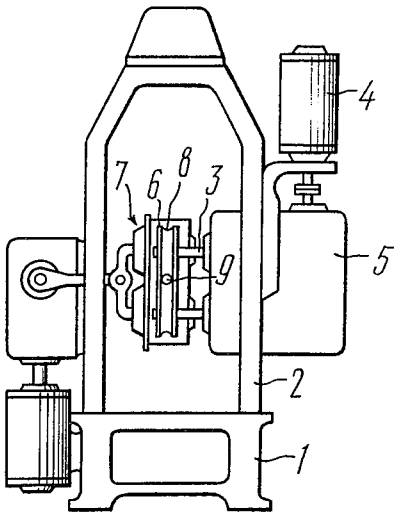
FIG. 2 is a side view of the machine illustrated in FIG. 1.

Mounted on the end of each shaft 3 is a roll 6, whereas the combination of the rolls 6 of both shafts 3 of a single stand 2 forms a pair 7 of rolls, in which the rolls 6 are located one above the other as illustrated in FIG. 2.

Each roll 6 has a groove 8, while the combination of grooves 8 of the rolls 6 of the pair 7 forms a pass 9 corresponding to the cross section of an article 10 propelled through these passes 9 (FIG. 3) in the course of straightening. To effect the process of straightening some pairs 7 of rolls, for example *7a*, are used for propelling the article, while the remaining pairs *7b* of pairs 7 are used for bending the article in at least one given plane.

Figures 3, 4:
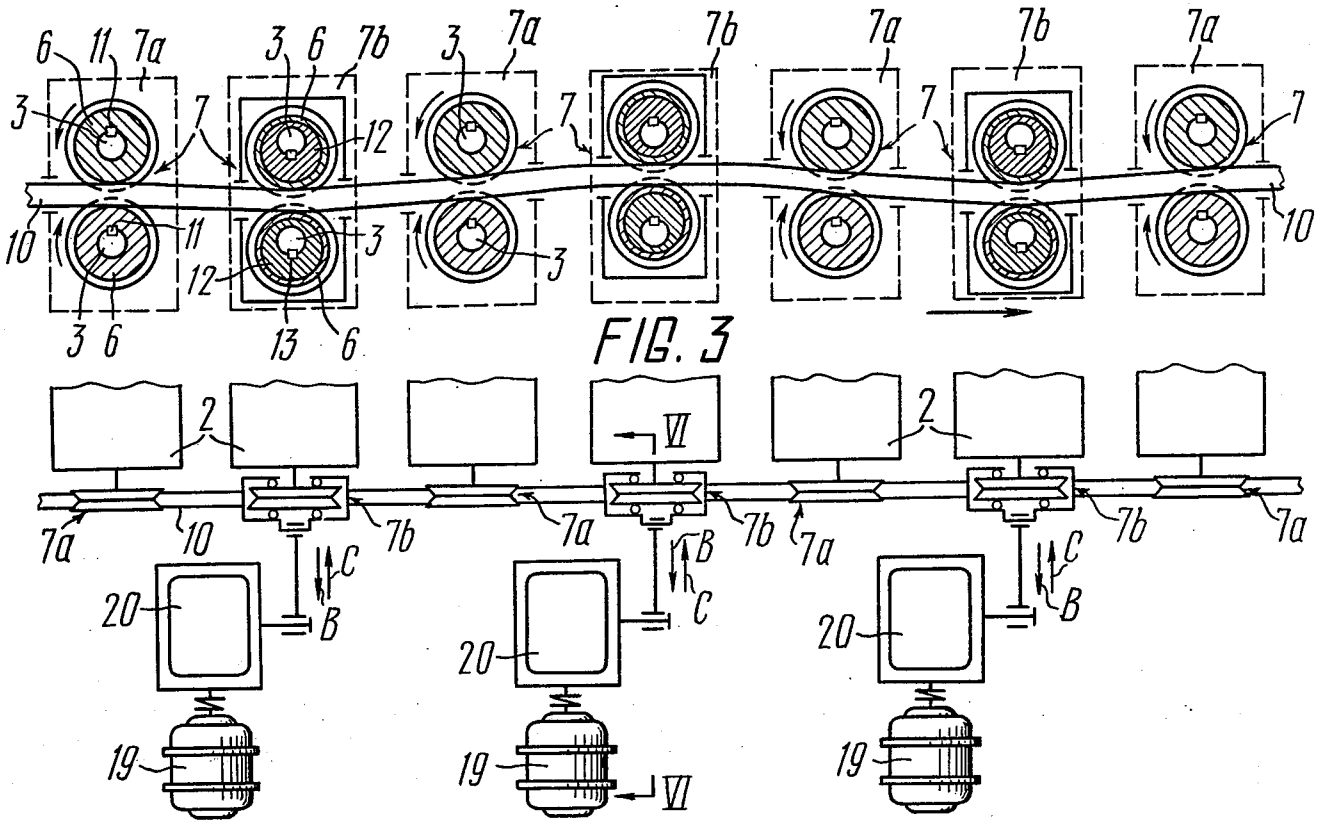
FIG. 3 is a schematic layout of stands with propelling and bending pairs of rolls.
FIG. 4 is a top view of the stands illustrated in FIG. 3.

The stands 2 which carry the propelling pairs *7a* of rolls are installed in the machine alternately with the pairs *7b* of rolls, as illustrated in FIGS. 3 and 4.

Figure 5:
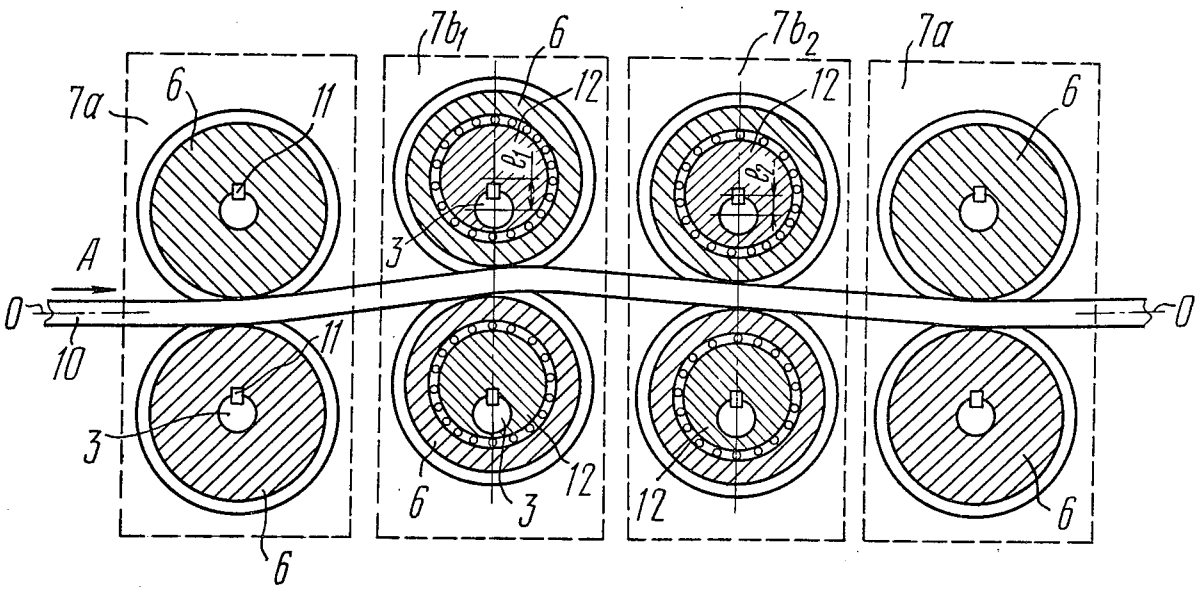
FIG. 5 is another layout version of stands positioning in the machine.

However, the stands which carry the propelling pairs *7a* of rolls can be also installed after every two stands carrying the bending pairs *7b* of rolls as illustrated in FIG. 5, which is principally determined by the feasibility of the straightening process based on the clear bending arrangement allowing the straightening accuracy to be improved and the bending force in the course of straightening to be reduced.

Each roll 6 in the propelling pair *7a* is rigidly fixed, for example by a key 11, on the corresponding shaft 3 and, while rotating together with the shaft, propels the article 10 in the direction indicated by arrow A (FIG. 5) through the passes of the roll pairs 7 of the entire machine, the passes of the roll pairs *7a* remaining stationary.

For bending the article in the given plane in the course of straightening, each roll 6 of the bending pairs *7b* is provided with an individual drive to rock the roll in this plane and as a result of rocking each roll of the pairs *7b* the passes formed by them perform a rocking motion relative to the straightening axis O—O (FIG. 5), thus subjecting the article 10 to elasto-plastic bending in this plane.

Each individual drive of the roll 6 of the bending pair *7b* (FIG. 6) is formed by the driving shaft 3 and an eccentric bushing 12 fixed on the shaft 3 for example by a key 13.

Figure 6:
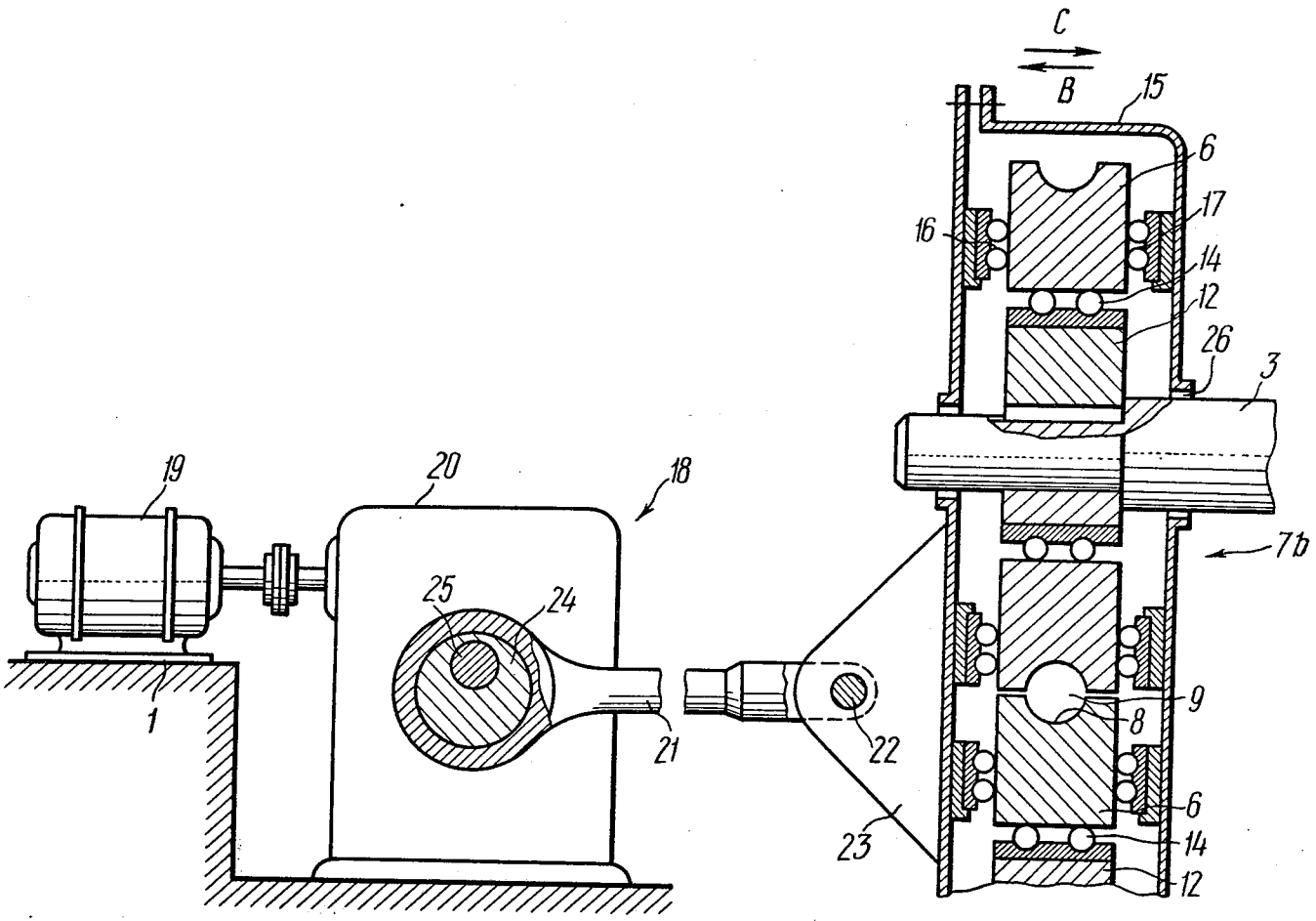
FIG. 6 is a sectional view taken along the line VI—VI in FIG. 4.

Freely seated on each eccentric bushing 12 through a bearing 14 is the roll 6 of the pair *7b*, which allows the roll 6 to rotate freely on the bushing. The bearing 14 is made in the form of thrust bearings, whose balls for example being mounted on small balls covered with hoods to prevent their falling out. Due to the above, the rotary motion of the shaft 3 is transformed by the eccentric bushing into a rocking motion of the roll 6. Each roll pair *7b* is enclosed in a holder 15 (FIG. 6). To reduce friction between the bending pair rolls 6 during their rocking and walls of the holder 15, these rolls 6 are resting on thrust bearings 16 and 17 (FIG. 6) whose balls for example are mounted on small balls covered with hoods to prevent their falling out.

Each bending pair *7b* of the rolls 6 is provided with a drive 18 (FIG. 6) for combine rocking of both rolls of the pair in a plane perpendicular to the given one, that is to the plane in which each roll of the pair is rocking due to the eccentric bushing 12. The roll pairs *7b* are rocking in directions indicated by arrows B and C. Because of the composition of rocking motions in two mutually perpendicular planes the passes of the roll pairs *7b* perform a circular motion for multiplanar bending of the article during its straightening, thus considerably improving the quality of straightening.

The drive 18 incorporates an electric motor 19, a reduction unit 20 and a crank and connecting-rod assembly. A connecting rod 21 of the crank and connecting-rod assembly is pivotally connected by its one end to the holder 15 through an axle 22 and a bracket 23 which is secured on the holder 15. By its other end of the connecting rod 21 encompasses a crank 24 (or eccentric) secured on an output shaft 25 of the reduction unit 20. To permit displacement of the roll pair 7*b* in the directions indicated by arrows B and C, the holder 15 encloses the shaft 3 with a clearance 26.

In the case when the stands with the bending roll pairs 7*b* (FIG. 5) are installed in the machine in groups of two, as illustrated in FIG. 5, the position of the eccentric bushings 12 of the drive of the first bending roll pair $7b_1$ (as to the direction of article travel) is identical to that of the eccentric bushings 12 of the drive of the second roll pair $7b_2$ for synchronous rocking of the rolls of these pairs (i.e. eccentricities $e_1$ and $e_2$ of the bushings 12 of the pairs $7b_1$ and $7b_2$ respectively lie in single direction without phase displacement). However, eccentricities $e_1$ of the eccentric bushings 12 of the roll pair $7b_1$ are larger than eccentricities $e_2$ of the eccentric bushings of the pair $7b_2$, providing the most favorable conditions for straightening the article. The value of eccentricities $e_1$ and $e_2$ can be varied for example by replacing the eccentric bushings 12 so as to establish such distribution of bending moments in the article being straightened at which a tetragonal bending-moment diagram is obtained. With this, the maximum plastic bending moment is created in the first roll pair $7b_1$ (as to the direction of article travel), while the maximum elastic bending moment is created in the second pair $7b_2$. Such tetragonal distribution of bending moments enlarges the length of the working zone with a resultant higher number of elasto-plastic bends of the article 10 being treated, without increasing the number of rocking movements of the roll pairs.

The machine of the instant invention operates as follows.

All the electric motors 4 (FIG. 1) are switched on simultaneously. They transmit rotation through the reduction units 5 to the driving shafts 3 with the propelling roll pairs 7*a* (FIG. 3) and the bending roll pairs 7*b*. In the course of rotation each roll 6 of the propelling pair 7*a* rotates together with the shaft 3, while each roll of the bending pair 7*b* due to the eccentric bushing 12 rotating together with the shaft 3 performs a rocking motion.

Now the article 10 is introduced into the pass of the first propelling pair 7*a* of rolls, for straightening. The rotating rolls 6 of this pair feed the article 10 further into the pass of the bending pair 7*b* of rolls. Because the rolls of this pair are rocking, the pass of this pair performs a rocking motion relative to straightening the axis O—O as a result the article 10 is being alternatly bent in a given plane. In case the article 10 has three-dimensional curvature the electric motors 19 (FIG. 6) are also switched on, each of these motors through the reduction unit 20 and the crank and connecting-rod assembly imparting a rocking, i.e. reciprocating motion to the bending roll pair 7*b* related to this motor in a plane perpendicular to the given one. As a result of the composition of the rocking motions of the roll pair 7*b* and of each roll 6 in this pair, the pass formed by them performs a circular motion and the article 10 is consequently subjected to a multiplanar alternating elasto-plastic bending and so straightened.

The article 10 (FIG. 3) is subjected to the similar bending in all the passes of the bending roll pairs 7*b* through which the article 10 is propelled by the roll pairs 7*a*. Due to the effect of the high frequency multiplanar bending, the article 10 is being straightened at sufficiently high accuracy and high speed of the process. The rocking frequency of the rolls 6 in the pairs 7*b* and the rocking frequency of the roll pairs 7*b* are adjusted by varying the speed of the electric motors 4 and 19 accordingly, while the value of rocking amplitude is varied by altering eccentricities $e_1$ and $e_2$ of the eccentric bushings (i.e. for example by replacing these bushings).

If the article 10 is subjected to straightening in machines wherein the stands with propelling pairs 7*a* of rolls 6 are each installed through an interval of two stands with the bending roll pairs 7*b* (as illustrated in FIG. 5) the article 10 in this case is bent in the course of straightening under smooth reduction of its deformation, to effect the straightening process at high accuracy and minimum energy consumption. This proceeds from the fact that the rolls of the bending pairs $7b_1$ and $7b_2$ are rocking synchronously and the rocking amplitude of the rolls in the first pair $7b_1$ (as to the direction of article travel) is larger than that of the rolls in the second pair $7b_2$.

What we claim is:

1. A paired-roll straightening machine comprising: a bed frame; stands stationarily installed on the bed frame in a row one after another; two driving shafts mounted in each of the stands one above the other; a roll positioned on each of the shafts so that the rolls of the shafts of one stand form a pair of rolls, while the rolls in each pair are installed one above the other to form a pass whose cross section corresponds to the cross section of an article being straightened, propelled through the passes of the roll pairs of all stands; some of the pairs of rolls are adapted for propelling the article; the remaining pairs of rolls are adapted for bending the article in at least one given plane during straightening; a drive provided for each roll of the bending pairs so that each roll of the bending pair is rocking in the given plane for bending the article during straightening; and means for rotating each of the shafts of the stands.

2. The paired-roll straightening machine as set forth in claim 1, wherein the drive for rocking the roll of the bending pair comprises a stand driving shaft and an eccentric bushing fixed on the shaft, and on the eccentric bushing the roll of the bending pair is freely seated.

3. The paired-roll straightening machine as set forth in claim 2, further comprising a drive for combine rocking both rolls of the bending pair in a plane perpendicular to the given plane and due to the composition of the rocking motions the pass formed by the bending pair of rolls performs circular motion for multiplanar bending of the article during straightening.

4. The paired-roll straightening machine as set forth in claim 3, wherein the drive for rocking the bending pair of rolls comprises a crank and a connecting-rod assembly whose connecting rod is pivotally connected to a holder encompassing the bending pair of rolls.

5. The paired-roll straightening machine as set forth in claim 2, wherein the stands carrying the driving shafts with the pairs of propelling rolls are stationarily installed after every two stands with the bending pairs of rolls, whereas the eccentric bushings of the drive of the first bending roll pair, as to article travel direction, are positioned identically to the eccentric bushings of the drive of the second bending roll pair for synchronous rocking of the rolls of the pairs.

6. The paired-roll straightening machine as set forth in claim 5, wherein an eccentricity of the drive eccentric bushings of the first pair of rolls, as to article travel direction, is larger than an eccentricity of the drive eccentric bushings of the second pair of rolls.

* * * * *